US012276103B2

(12) United States Patent
Wu et al.

(10) Patent No.: US 12,276,103 B2
(45) Date of Patent: Apr. 15, 2025

(54) STIRRUP MODULE FOR BEAM REINFORCEMENT SYSTEM AND MANUFACTURING METHOD OF BEAM REINFORCEMENT SYSTEM

(71) Applicant: CHIEN KUO CONSTRUCTION CO., LTD., Taipei (TW)

(72) Inventors: Chang-Shiou Wu, Taipei (TW); Sheng-Yi Yen, Taipei (TW); Chia-Hsuan Huang, Taipei (TW)

(73) Assignee: CHIEN KUO CONSTRUCTION CO., LTD., Taipei (TW)

( * ) Notice: Subject to any disclaimer, the term of this patent is extended or adjusted under 35 U.S.C. 154(b) by 150 days.

(21) Appl. No.: 17/961,267

(22) Filed: Oct. 6, 2022

(65) Prior Publication Data

US 2023/0115539 A1 Apr. 13, 2023

(30) Foreign Application Priority Data

Oct. 8, 2021 (TW) ..... 110137549

(51) Int. Cl.
*E04C 5/06* (2006.01)

(52) U.S. Cl.
CPC ..... *E04C 5/0622* (2013.01); *E04C 5/0604* (2013.01)

(58) Field of Classification Search
CPC ..... E02D 27/08; E04C 5/0604; E04C 5/0622; E04C 5/0609; E04C 5/0613; E04C 5/0618; E04C 5/0627; E04C 5/0631; E04C 5/0636; E04C 5/064; E04C 5/16
See application file for complete search history.

(56) References Cited

U.S. PATENT DOCUMENTS

| | | | | |
|---|---|---|---|---|
| 931,943 | A * | 8/1909 | Martin | E04C 5/18 52/649.8 |
| 994,091 | A * | 5/1911 | Brussel | E04C 5/06 52/649.1 |
| 1,240,137 | A * | 9/1917 | Hartman | E04C 5/18 52/687 |
| 1,988,081 | A * | 1/1935 | Kemper | E04C 5/16 52/647 |
| 3,672,022 | A * | 6/1972 | York | B21F 27/005 428/116 |
| 6,293,071 | B1 * | 9/2001 | Konstantinidis | E04C 5/0609 52/659 |
| 2005/0257482 | A1 * | 11/2005 | Galluccio | E04C 5/0618 52/649.2 |

(Continued)

*Primary Examiner* — Kyle J. Walraed-Sullivan

(74) *Attorney, Agent, or Firm* — MUNCY, GEISSLER, OLDS & LOWE, P.C.

(57) ABSTRACT

A stirrup module includes a bottom rib and a first erect bar, a second erect bar, a third erect bar and a fourth erect bar that are arranged in parallel to each other. The third erect bar is located between the first erect bar and the second erect bar. The fourth erect bar is located between the third erect bar portion and the second erect bar portion. A first gap is between the first erect bar and the third erect bar, and a second gap is between the second erect bar and the fourth erect bar. The bottom rib connects the bottom ends of the first erect bar, the second erect bar, the third erect bar and the fourth erect bar, and the first gap and the second gap are each formed with an opening at the end opposite to the bottom rib.

16 Claims, 12 Drawing Sheets

(56) References Cited

U.S. PATENT DOCUMENTS

| | | | | |
|---|---|---|---|---|
| 2006/0059804 | A1* | 3/2006 | Brown | E04C 5/0645 52/223.13 |
| 2007/0039276 | A1* | 2/2007 | Sorensen | E04C 5/0627 52/633 |
| 2007/0157541 | A1* | 7/2007 | Mossbeck | E04C 5/18 52/677 |
| 2017/0218629 | A1* | 8/2017 | Rao Vemuri | E04C 5/0604 |
| 2019/0078316 | A1* | 3/2019 | Yin | E04C 5/0609 |
| 2021/0047832 | A1* | 2/2021 | Giles | E02D 31/08 |
| 2021/0121938 | A1* | 4/2021 | Sacks | E04C 5/0636 |
| 2022/0268024 | A1* | 8/2022 | Yin | E04C 5/0622 |
| 2023/0323666 | A1* | 10/2023 | Wu | E04C 3/34 52/831 |

* cited by examiner

STIRRUP MODULE FOR BEAM REINFORCEMENT SYSTEM AND MANUFACTURING METHOD OF BEAM REINFORCEMENT SYSTEM

BACKGROUND OF THE INVENTION

1. Field of the Invention

The present invention relates to a stirrup module; specifically relates to a stirrup module for beam reinforcement system and manufacturing method of beam reinforcement system.

2. Description of the Prior Art

Structures using reinforced concrete (RC) are often used in the construction engineering. Conventional beam reinforcement system in the reinforced concrete structures mainly includes a plurality of main bars arranged in parallel with each other and a plurality of stirrups for bundling the main bars. The stirrups are mainly tightened and positioned on the main bars, and compose reinforced main structures in the reinforced concrete structures. Then templates are manufactured around the reinforced structure, concrete grouting is processed hereafter and structures of Reinforced Concrete are formed immediately.

In recent years, a hooping stirrup structure has been developed, which is provided on the surface across the main bars, so that hooping force can be distributed evenly across the cross-section of the beam. However, it is not convenient to add more main bars after the stirrups have been disposed, and it takes longer time to do so. Therefore, it is essential to solve problems in the current arts so as to enhance convenience of construction and shorten its manufacturing time.

SUMMARY OF THE INVENTION

The present invention intends to provide a stirrup module for beam reinforcement system, used for enhancing convenience of construction and shortening the construction time of beam reinforcement systems. The stirrup module of the present invention in an embodiment includes a first erect bar portion, a second erect bar portion arranged in parallel with the first erect bar portion, a third erect bar portion, a fourth erect bar portion, and a bottom rib section. The third erect bar portion is arranged in parallel with the first erect bar portion and located between the first erect bar portion and the second erect bar portion; the fourth erect bar portion is arranged in parallel with the first erect bar portion and is located between the third erect bar portion and the second erect bar portion. Wherein a first gap is formed between the first erect bar portion and the third erect bar portion, a second gap is formed between the second erect bar portion and the fourth erect bar portion. The bottom rib section is configured to connect bottom ends of at least portions of the first erect bar portion, the second erect bar portion, the third erect bar portion, and the fourth erect bar portion, and to form bottom portions of the first gap and the second gap; and wherein the first gap and the second gap are each formed with an opening at the end opposite to the bottom rib section.

The stirrup module in another embodiment includes a fifth erect bar portion and a sixth erect bar portion arranged in parallel with the first erect bar portion, and the fifth erect bar portion is located between the first erect bar portion and the sixth erect bar portion. Wherein a third gap is formed between the fifth erect bar portion and the first erect bar portion, and the first gap is between the sixth erect bar portion and the third erect bar portion. The second gap is between the second erect bar portion and the fourth erect bar portion. The bottom rib section is configured to connect bottom ends of at least portions of the first erect bar portion, the second erect bar portion, the third erect bar portion, the fourth erect bar portion, the fifth erect bar portion, and the sixth erect bar portion and to is configured to form bottom portions of the first gap, the second gap, and the third gap. In addition, the first gap, the second gap and the third gap are each formed with an opening at the end opposite to the bottom rib section.

The stirrup module in another embodiment includes a first erect bar portion, a second erect bar portion arranged in parallel with the first erect bar portion, a first inner ring disposed between the first erect bar portion and the second erect bar portion, a first bottom rib and a second bottom rib. Wherein a first gap is between the first erect bar portion and the first inner ring; a second gap is between the second erect bar portion and the first inner ring. The first bottom rib is configured to connect bottom ends of at least portions of the first erect bar portion and the first inner ring to form a bottom portion of the first gap. The second bottom rib is configured to connect bottom ends of at least portions of the second erect bar portion and the first inner ring to form a bottom portion of the second gap. The first gap is formed with an opening at the end opposite to the second bottom rib. The second gap is formed with an opening at the end opposite to the first bottom rib.

The stirrup module in another embodiment further includes a second inner ring and a third bottom rib. The second inner ring is disposed between the first erect bar portion and the third erect bar portion. A third gap is between the first erect bar portion and the second inner ring. The third bottom rib is configured to connect the first bottom ends of at least portions of the first erect bar portion and the second inner ring and to form a bottom portion of the third gap.

The stirrup module in another embodiment includes a first erect bar portion having a first bend portion; a first bottom rib bended relative to the first erect bar portion from the first bend portion and having a second bend portion; a fourth erect bar portion bended relative to the first bottom rib from the second bend portion, the fourth erect bar portion arranged in parallel with the first erect bar portion and having a third bend portion, a first top rib bended relative to the first erect bar portion from the third bend portion, the first top rib arranged in parallel with the first bottom rib and having a fourth bend portion; a third erect bar portion bended relative to the first bottom rib from the fourth bend portion, the third erect bar portion arranged in parallel with the first erect bar portion and having a fifth bend portion; and a second bottom rib bended relative to the first erect bar portion from the fifth bend portion and having a sixth bend portion, wherein the second bottom rib and the first bottom rib are disposed to be staggered and overlapped with each other. Wherein a first gap is between the first erect bar portion and the third erect bar portion, a second gap is between the second erect bar portion and the fourth erect bar portion; wherein the first gap and the second gap are respectively formed with an opening at the end opposite to the first bottom rib and the second bottom rib.

The stirrup module in another embodiment includes a fifth erect bar portion bended relative to the first bottom rib from the seventh bend portion, the fifth erect bar portion arranged in parallel with the first erect bar portion and extending to the fifth erect bar portion having an eighth bend portion; a second top rib bended relative to the first erect bar portion from the eighth bend portion and extending to the second top rib having a nineth bend portion; a sixth erect bar portion bended relative to the second top rib from the nineth bend portion to be arranged in parallel with the first erect bar portion and extending to the sixth erect bar portion having a tenth bend portion; a third bottom rib is bended relative to the fifth erect bar portion from the tenth bend portion to be arranged in parallel with the second top rib and extending and connecting to the first bend portion of the first erect bar portion. Wherein the first gap is between the sixth erect bar portion and the third erect bar portion; wherein the second gap is between the second erect bar portion and the fourth erect bar portion; wherein the third gap is between the first erect bar portion and the fifth erect bar portion; wherein the first gap is formed with an opening at the end opposite to the first bottom rib; and wherein the second gap and the third gap are each formed with an opening at the end opposite to one end of the second bottom rib and the third bottom rib.

In order to achieve the mentioned purposes, the manufacturing method of beam reinforcement system of the present invention includes steps of: arranging two first main bars in parallel with each other; hanging a plurality of stirrup modules on the two first main bars; providing a plurality of second main bars on bottom rib sections of the plurality of stirrup modules via the openings; providing a plurality of third main bars on the plurality of stirrup modules; wherein the first main bars and the third main bars are arranged in parallel with each other; and providing a plurality of stirrup caps on the plurality of stirrup modules; wherein the stirrup caps are disposed corresponding to the openings.

DETAILED DESCRIPTION OF THE PREFERRED EMBODIMENT

In order to make people skilled in the art further understand the purposes, the structures, and the effects of the present invention, the present invention will be described in detail using preferred embodiments with reference to drawings.

Figure 1:
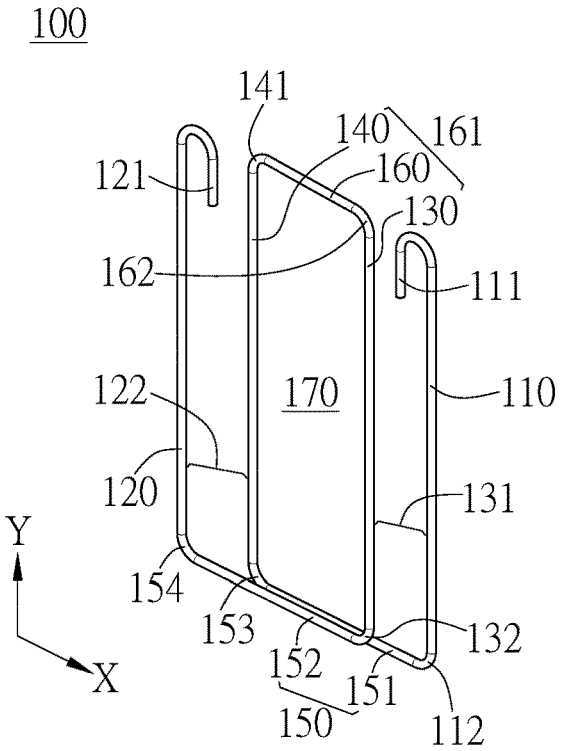
FIG. 1 is a perspective view of the stirrup module of the first embodiment of the present invention.
Figure 2:
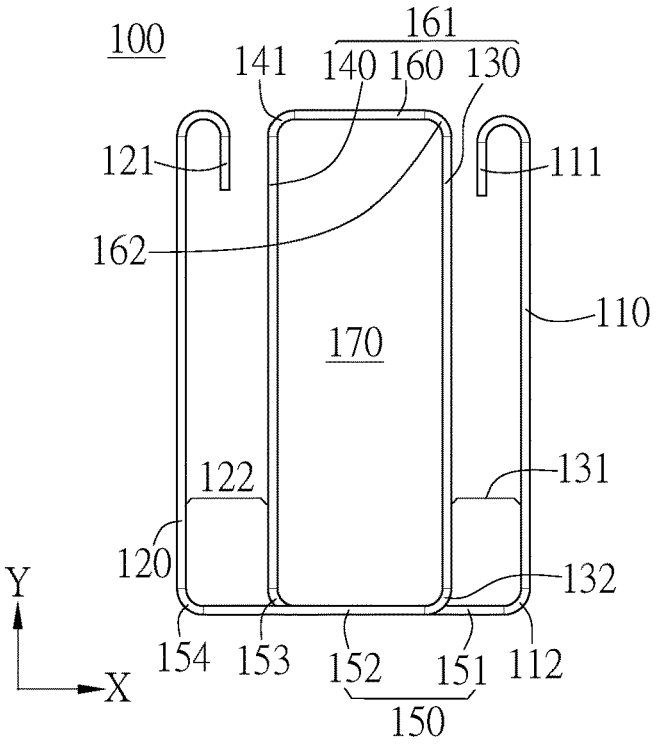
FIG. 2 is a side view of the stirrup module of the first embodiment of the present invention.

Firstly, please refer to FIG. 1 and FIG. 2, which illustrate a first embodiment of the stirrup module of the present invention, the stirrup module 100 of the present invention a first erect bar portion 110, a second erect bar portion 120, a third erect bar portion 130, a fourth erect bar portion 140, and a bottom rib section 150. The first erect bar portion 110 is arranged in parallel with the second erect bar portion 120 along a first direction X. In addition, each of the first erect bar portion 110 and the second erect bar portion 120 has a hook end 111/121 which can be hooked on main bars. the hook ends 111/121 are disposed on top ends of the first erect bar portion 110 and the second erect bar portion 120 along a second direction Y. In the present embodiment of the invention, the hook ends 111/121 enable the first erect bar portion 110 and the second erect bar portion 120 be capable of hooked on the main bars of the beam reinforcement stably. The appearance of the hook ends 111/121 illustrated in FIG. 1 and FIG. 2 are not limited thereto. The third erect bar portion 130 is also arranged in parallel with the first erect bar portion 110 along the first direction X and located between the first erect bar portion 110 and the second erect bar portion 120. The fourth erect bar portion 140 is also arranged in parallel with the first erect bar portion 110 along the first direction X, and located between the third erect bar portion 130 and the second erect bar portion 120. Specifically, from the second erect bar portion 120, the fourth erect bar portion 140, the third erect bar portion 130, and the first erect bar portion 110 are sequentially arranged in parallel with each other along the first direction X. So that a first gap 131 is between the first erect bar portion 110 and the third erect bar portion 130, and a second gap 122 is between the second erect bar portion 120 and the fourth erect bar portion 140.

The bottom rib section 150 is configured to connect bottom ends of at least portion of the first erect bar portion 110, the second erect bar portion 120, the third erect bar portion 130, and the fourth erect bar portion 140. In the present embodiment, as illustrated in FIG. 1, the bottom rib section 150 includes a first bottom rib 151 and a second bottom rib 152. The first bottom rib 151 is connected to a bottom end of the first erect bar portion 11, a bottom end of the fourth erect bar portion 140 is connected to the first bottom rib 15; that is, the first erect bar portion 110 is connected to the fourth erect bar portion 140 via the first bottom rib 151; and the first bottom rib 151 of the bottom rib section 150 is configured to form a bottom portion of the first gap 131. The second bottom rib 152 is connected to a bottom end of the second erect bar portion 120; a bottom end of the third erect bar portion 130 is connected to the second bottom rib 152; the second erect bar portion 120 is connected to the third erect bar portion 130 via the second bottom rib 152; and the second bottom rib 152 of the bottom rib section 150 forms a bottom portion of the second gap 122. Wherein the first gap 131 and the second gap 122 are respectively formed with an opening at the end opposite to at least portions of the first bottom rib 151 and the second bottom rib 152 of the bottom rib section 150. The rest of the first bottom rib 151 and the second bottom rib 152 are at least partially disposed on a same horizontal surface so that the first bottom rib 151 and the second bottom rib 152 are at least partially overlapped with each other.

The stirrup module 100 of the first embodiment of the present invention further includes a first top rib 160. The first top rib 160 is connected to the third erect bar portion 130;

the fourth erect bar portion 140 is connected to the first top rib 160; the third erect bar portion 130 is connected to the fourth erect bar portion 140 via the first top rib 160. Specifically, a top end of the third erect bar portion 130 is connected to the first top rib 160, and extends along the first direction X to be connected to the fourth erect bar portion 140 via the first top rib 160. In addition, the third erect bar portion 130, the first top rib 160, and the fourth erect bar portion 140 are configured to form a first hang portion 161 by the aforementioned connection settings. Each of the erect bar portions, top ribs, and bottom ribs, and the connection relationships thereof are preferably integrally formed by bending a single piece of steel bar; however, they are not limited thereto.

In another aspect, in the stirrup module 100 of the present invention, the third erect bar portion 130, the fourth erect bar portion 140, the first top rib 160, at least portion of the first bottom rib 151 and at least portion of the second bottom rib 152 together form a first inner ring 170.

Wherein the first inner ring 170 is provided between the first erect bar portion 110 and the second erect bar portion 120 along the first direction X; and the first gap 131 is between the first erect bar portion 110 and the first inner ring 170; the second gap 122 is between the second erect bar portion 120 and the first inner ring 170.

The first bottom rib 151 is configured to connect bottom ends of the first erect bar portion 110 and the fourth erect bar portion 140, the bottom end of the first erect bar portion 110 extends along the first direction X passing through the first bottom rib 151 to be disposed on the bottom end of the fourth erect bar portion 140. In addition, at least portion of the first bottom rib 151 is configured to form the bottom portion of the first gap 131; that is, the first gap 131 is formed with an opening at the end opposite to at least portion of the first bottom rib 151. The second bottom rib 152 is configured to connect bottom ends of the third erect bar portion 130 and the second erect bar portion 120; the bottom end of the second erect bar portion 120 extends along the first direction X passing through the second bottom rib 152 to be disposed on the bottom end of the third erect bar portion 130. In addition, at least portion of the second bottom rib 152 forms the bottom portion of the second gap 122; that is, the second gap 122 is formed with an opening at the end opposite to the second bottom rib 152. The aforementioned connection ways make the first bottom rib 151 and the second bottom rib 152 be arranged in a same horizontal surface. In addition, the first bottom rib 151 and the second bottom rib 152 are at least partially staggered and overlapped with each other.

Preferably, the aforementioned embodiment can be integrally manufactured by bending a single piece of steel bar. Specifically, the stirrup module 100 of the present invention is bended relative to the first erect bar portion 110 from a connection portion of a first bend portion 112 of the first erect bar portion 110 and extending to the first bottom rib 151 having the second bend portion 153; bended relative to the first bottom rib 151 from a connection end of the second bend portion 153 to be arranged in parallel with the first erect bar portion 110 and extending to the fourth erect bar portion 140 having the third bend portion 141; bended relative to the first erect bar portion 110 from a connection end from the third bend portion 141 to be arranged in parallel with the first bottom rib 151 and extending to the first top rib 160 having the fourth bend portion 162; bended relative to the first bottom rib 151 from a connection end of the fourth bend portion 162 to be arranged in parallel with the first erect bar portion 110 and extending to the third erect bar portion 130 having the fifth bend portion 132; bended relative to the first erect bar portion 110 from a connection end of the fifth bend portion 132 and extending to the second bottom rib 152 having a sixth bend portion 154, and arranged to be staggered and overlapped with the first bottom rib 151; bended relative to the second bottom rib 152 from a connection end of the sixth bend portion 154 so as to be arranged in parallel with a fifth erect bar portion 180.

Second Embodiment

Figure 3:
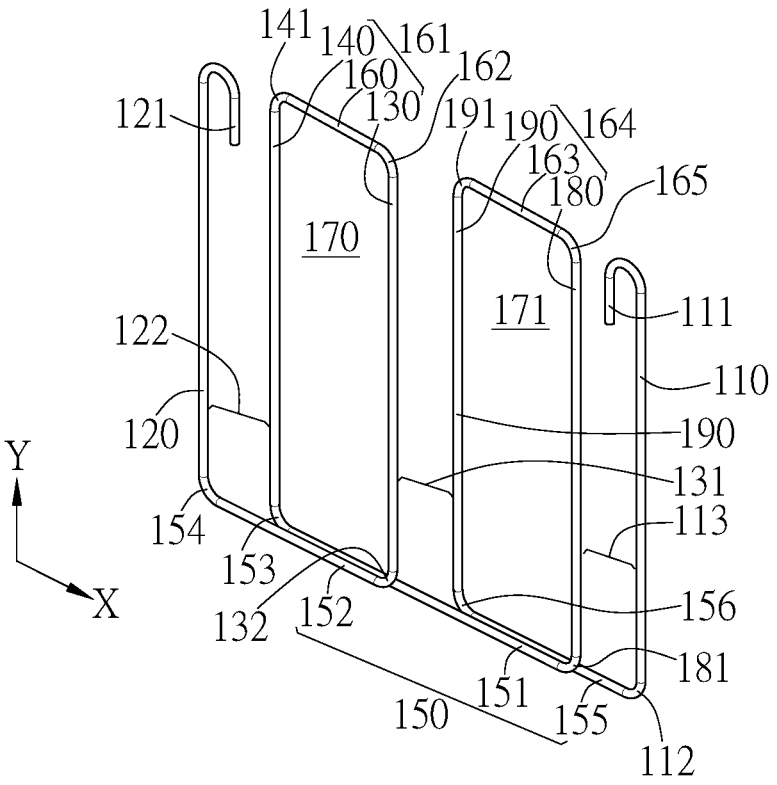
FIG. 3 is a perspective view of the stirrup module of the second embodiment of the present invention.
Figure 4:
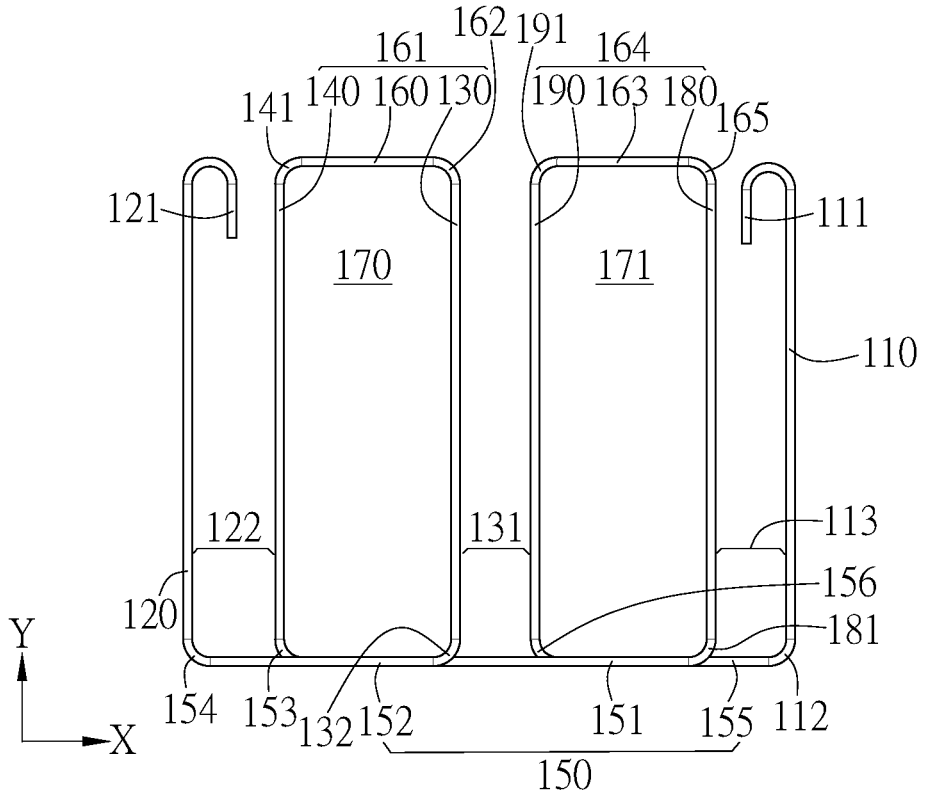
FIG. 4 is a side view of the stirrup module of the second embodiment of the present invention.

Please refer to FIG. 3 and FIG. 4 illustrating the second embodiment of the stirrup module of the present invention. It is different from the first embodiment of the present invention in that the stirrup module 100 of the present invention further includes a fifth erect bar portion 180 and a sixth erect bar portion 190. The fifth erect bar portion 180 is arranged in parallel with the first erect bar portion 110 along the first direction X. The sixth erect bar portion 190 is arranged in parallel with the first erect bar portion 110 along the first direction X; and the fifth erect bar portion 180 is located between the first erect bar portion 110 and the sixth erect bar portion 190. Wherein a third gap 113 is between the fifth erect bar portion 180 and the first erect bar portion 110 along the first direction X; the first gap 131 is between the sixth erect bar portion 190 and the third erect bar portion 130 along the first direction X; the second gap 122 is between the second erect bar portion 120 and the fourth erect bar portion 140 along the first direction X. Wherein the second erect bar portion 120 and the first erect bar portion 110 have hook ends 121/11 which can be hooked on at least one main bar. In the embodiment of the present invention, the purpose of providing the hook ends 121/111 is to be hooked on the main bars of the beam reinforcement stably; therefore, external forms of hook ends 121/111 illustrated in FIG. 3 to FIG. 4 are not limited thereto.

The present embodiment is different from the first embodiment of the present invention in that the bottom rib section 150 of the stirrup module 100 of the present invention further includes a third bottom rib 155. The bottom rib section 150 is configured to connect bottom ends of at least portions of the first erect bar portion 110, the second erect bar portion 120, the third erect bar portion 130, the fourth erect bar portion 140, the fifth erect bar portion 180, and the sixth erect bar portion 190. Furthermore, the fifth erect bar portion 180 is connected to the fourth erect bar portion 140 via the first bottom rib 151; the second erect bar portion 120 is connected to the third erect bar portion 130 via the second bottom rib 152; the first erect bar portion 110 is connected to the sixth erect bar portion 190 via the third bottom rib 155. In addition, the first bottom rib 151 and the second bottom rib 152 are disposed to be staggered and overlapped with each other in the first direction X; the first bottom rib 151 and the third bottom rib 155 are staggered and overlapped with each other in the first direction X, so that the first bottom rib 151 at least partially forms the bottom portion of the first gap 131, the second bottom rib 152 at least partially forms the bottom portion of the second gap 122, and the third bottom rib 155 at least partially forms the bottom portion of the third gap 113. In addition, the first gap 131, the second gap 122, and the third gap 113 are respectively formed with an opening at the end opposite to the first bottom rib 151, the second bottom rib 152, and the third bottom rib 155 of the bottom rib section 150.

The present embodiment is different from the first embodiment of the present invention in that the stirrup module 100 of the present invention further includes a second top rib 163. The second top rib 163 is connected to the fifth erect bar portion 180, the sixth erect bar portion 190 is connected to the second top rib 163, so that the fifth erect bar portion 180 is connected to the sixth erect bar portion 190 via the second top rib 163. Wherein the fifth erect bar portion 180, the second top rib 163, and the sixth erect bar portion 190 are configured to form a second hang portion 164 hooked on at least one main bar horizontally.

In another aspect, in the second embodiment of the present invention, the fifth erect bar portion 180, the sixth erect bar portion 190, and the second top rib 163 and at least portion of the first bottom rib 151 and at least portion of the third bottom rib 155 form a second inner ring 171. The second inner ring 171 and the first inner ring 170 are arranged in parallel with each other in the first direction X and in a direction toward the first erect bar portion 110, so that the second inner ring 171 is provided between the first erect bar portion 110 and the third erect bar portion 130.

Wherein the third gap 113 is between the second inner ring 171 and the first erect bar portion 110 along the first direction X. The third bottom rib 155 is configured to connect bottom ends of at least portions of the first erect bar portion 110 and the second inner ring 171 to form the bottom portion of the third gap 113. The fifth erect bar portion 180, the sixth erect bar portion 190, and the second top rib 163 of the second inner ring 171 are configured to form the second hang portion 164.

The third bottom rib 155 extends along the first direction X to be disposed on the bottom ends of the first erect bar portion 110 and the sixth erect bar portion 190; and the bottom end of at least portion of the third bottom rib 155 forms the bottom portion of the third gap 113. Wherein the third bottom rib 155 connects the first erect bar portion 110 and the sixth erect bar portion 190; the first bottom rib 151 connects the fourth erect bar portion 140 and the fifth erect bar portion 180; the second bottom rib 152 connects the second erect bar portion 120 and the third erect bar portion 130 so that the first bottom rib 151 and the second bottom rib 152 are disposed to be staggered and overlapped with each other. the third bottom rib 155 and the first bottom rib 151 are disposed to be staggered and overlapped with each other.

Preferably, the stirrup module 100 of the second embodiment of the present invention can be integrally manufactured by bending a single piece of steel bar. Specifically, the stirrup module 100 of the present invention includes the fifth erect bar portion 180 having a seventh bend portion 181 and bended from the first bottom rib 151; bended relative to the first erect bar portion 110 to from a connection end of the seventh bend portion and extending to the second top rib 163 having a eighth bend portion 165; bended relative to the fifth erect bar portion 180 a connection end of the eighth bend portion 165 so as to be arranged in parallel with the first bottom rib 151 and extending to the sixth erect bar portion 190 having the nineth bend portion 191; bended relative to the second top rib 163 from a connection end of the nineth bend portion 191 so as to be arranged in parallel with the fifth erect bar portion 180 and extending to the third bottom rib 155 having a tenth bend portion 156; bended relative to the fifth erect bar portion 180 from a connection end of the tenth bend portion 156 so as to be arranged to be staggered and overlapped with the first bottom rib 151.

In summary, the number of erect bar portions, bottom ribs, and top ribs can be adjusted in accordance with the widths between the main bars according to this embodiment. The aforementioned elements can together form the inner ring and have multiple loops such as stirrup with triple loops or stirrup with four loops by bending a single piece of steel bar.

Third Embodiment

Figure 5:
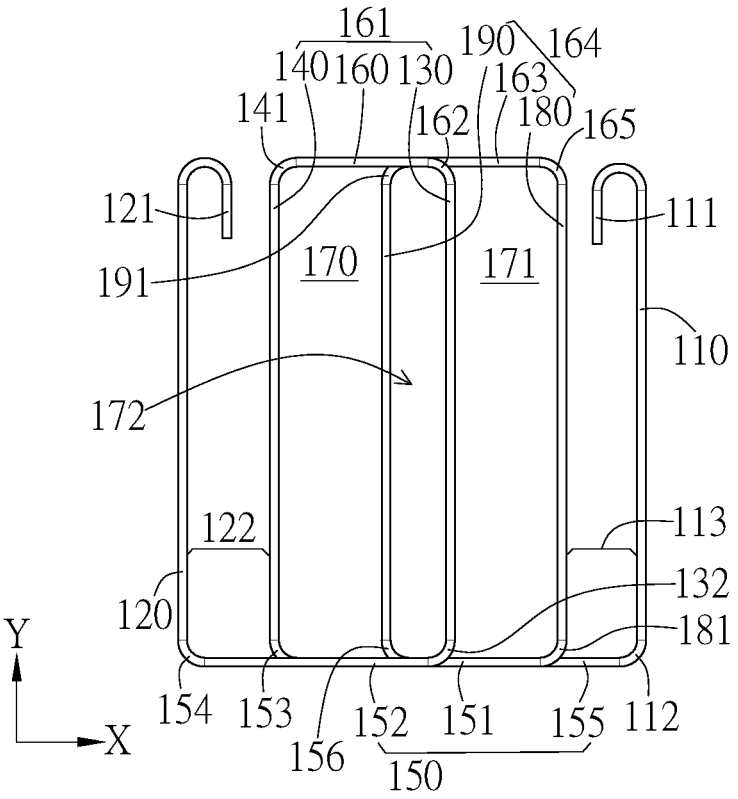
FIG. 5 is a side view of the stirrup module of the third embodiment of the present invention.

Please refer to FIG. 5 illustrating the third embodiment of the structure of the stirrup module of the present invention. The present embodiment is different from the stirrup module 100 of the second embodiment of the present invention in that the first inner ring 170 and the second inner ring 171 can be partially overlapped with each other. A third inner ring 172 is formed in the space where the first inner ring 170 and the second inner ring 171 are overlapped with each other. The third inner ring 172 is configured to extend from a portion where at least portion of the first top rib 160 and at least portion of the second top rib 163 are overlapped with each other along a second direction Y to the bottom ends of the third erect bar portion 130 and the sixth erect bar portion 190.

Figure 6:
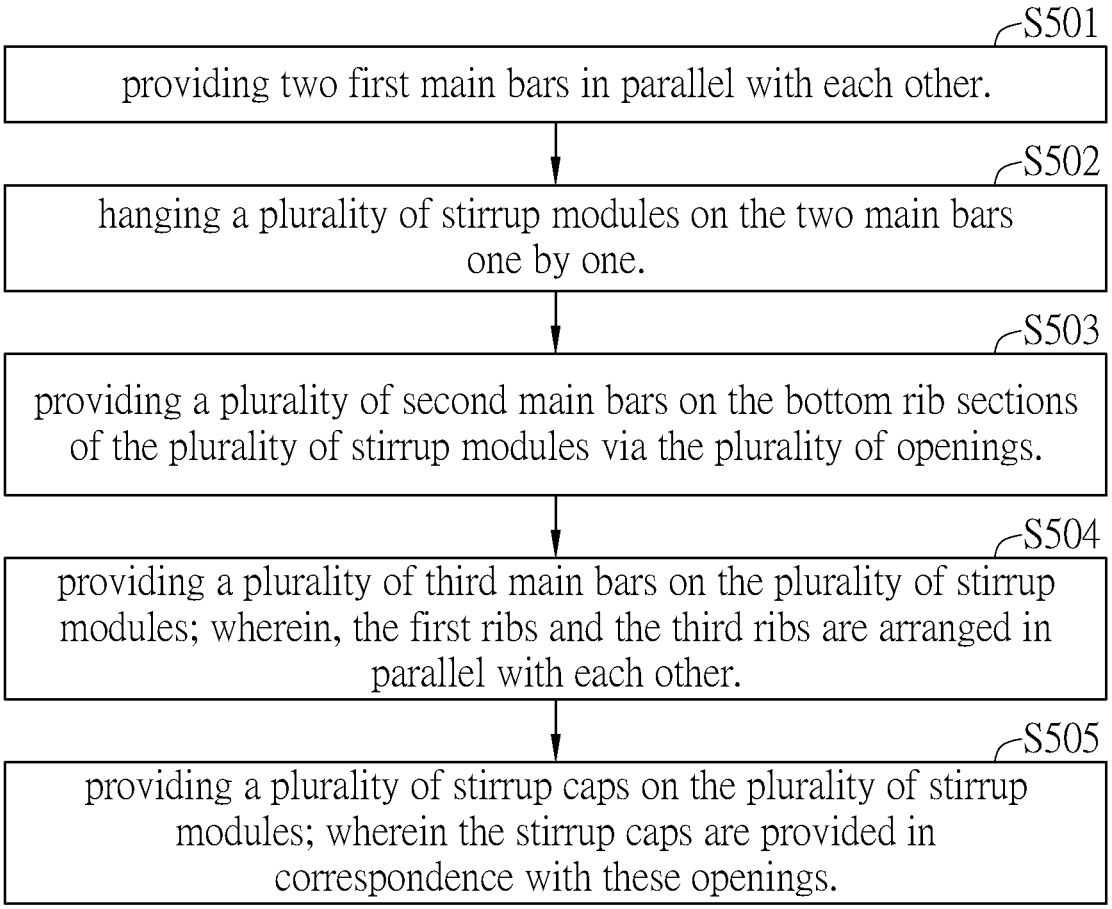
FIG. 6 is a flowchart of main steps of the manufacturing method of beam reinforcement system of the present invention.
Figure 7:
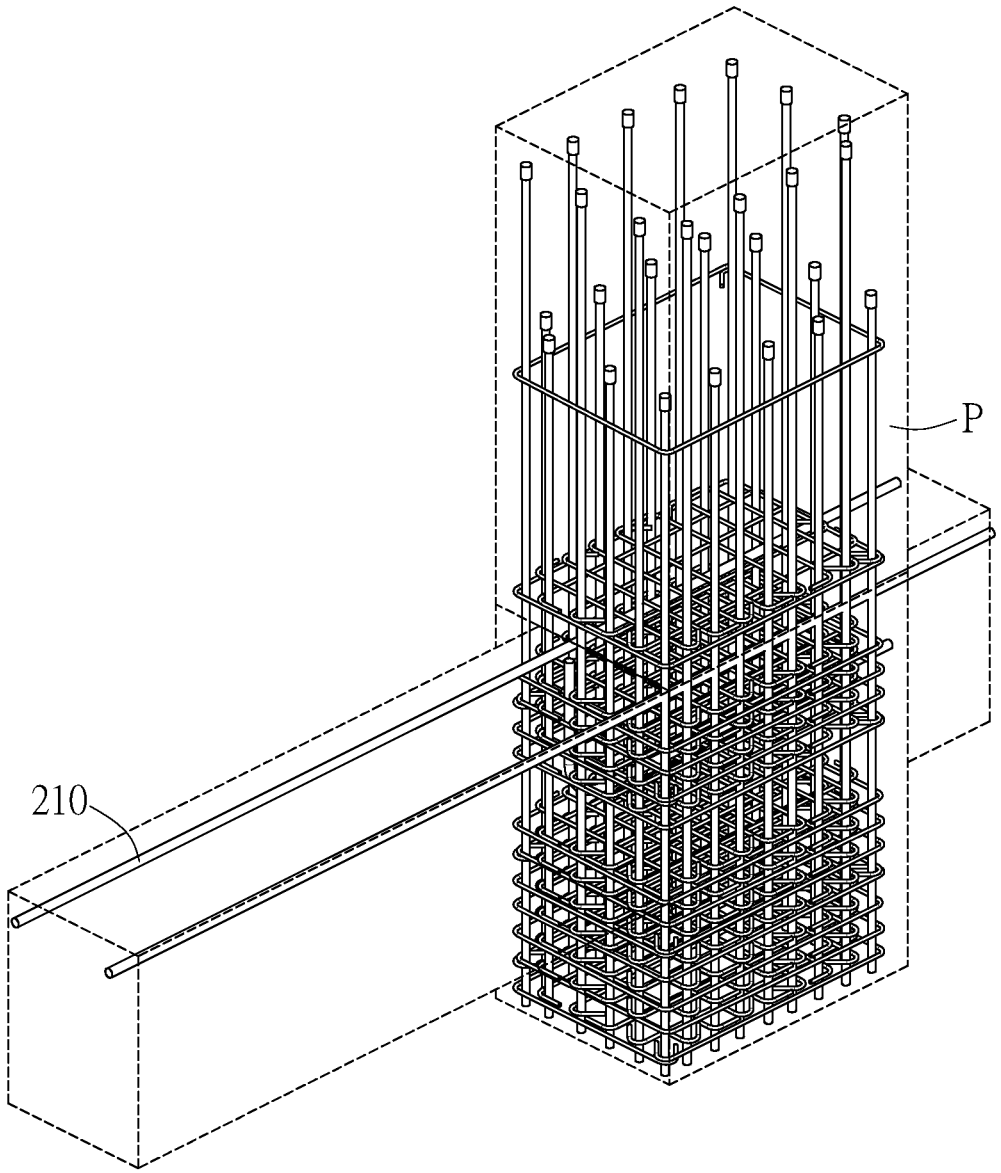
FIG. 7 shows the state of the main step 1 of the manufacturing method of the present invention.

Please refer to FIG. 6 illustrating main steps of the manufacturing method of beam reinforcement system of the present invention. It takes the first embodiment of the present invention for example. The manufacturing method of the present invention starts from a step S501 of providing two first main bars 210 in parallel with each other. Specifically, as illustrated in FIG. 7, the two first main bars 210 are configured to pass through a vertical reinforcing steel body P in a parallel direction and the two first ribs 210 are configured to be paralleled with each other on a same horizontal surface.

Figure 8:
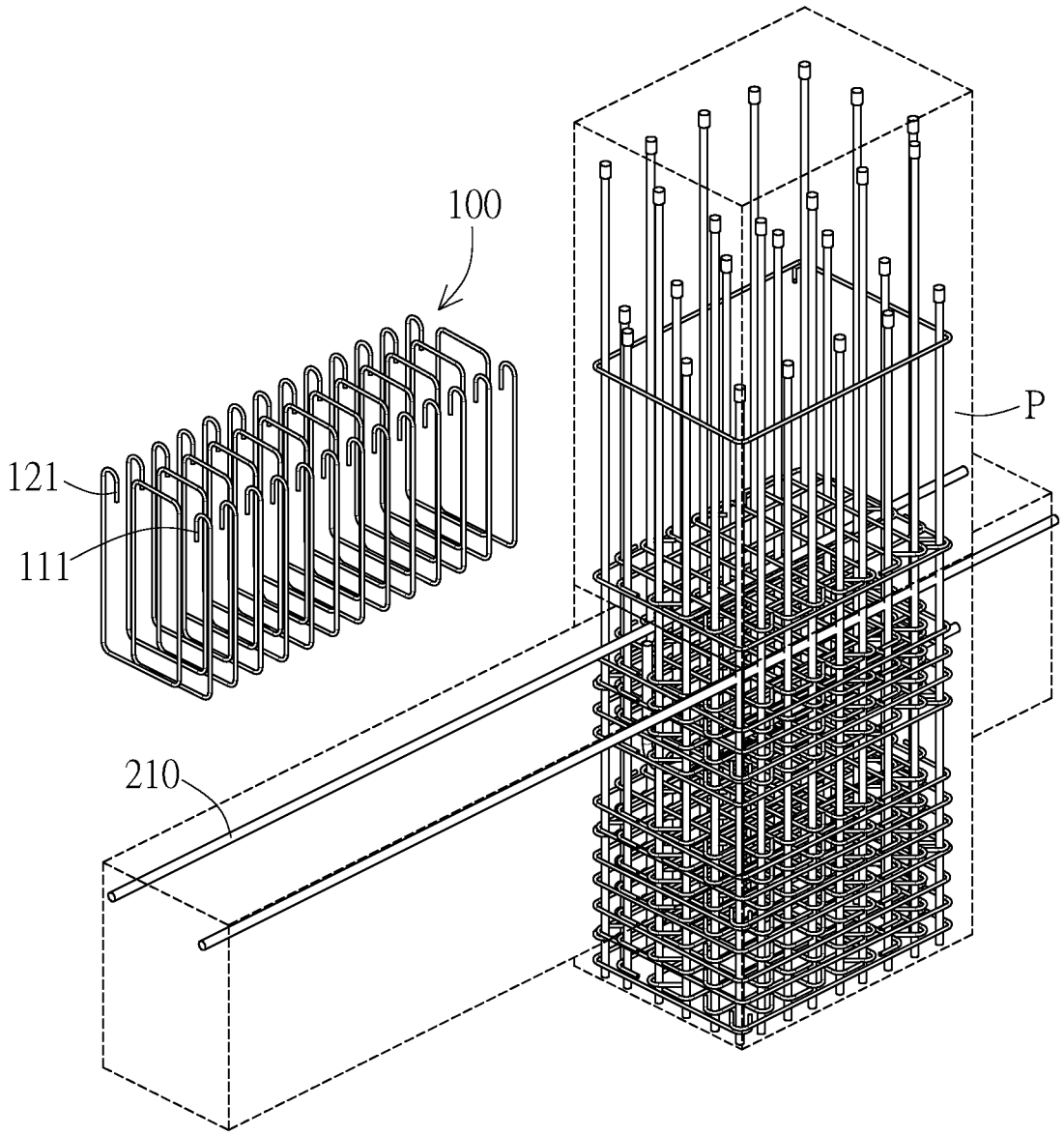
FIG. 8 shows the state of the main step 2 of the manufacturing method of the present invention.

The manufacturing method of the present invention is proceeded to a step S502 of hanging a plurality of stirrup modules 100 on the two main bars 210 one by one. Specifically, as illustrated in FIG. 8, the stirrup modules 100 of the present invention are hanged on the first ribs 210 via the hook ends 111/121, so that the plurality of stirrup modules 100 are hooked on the two main bars 210.

Figure 9:
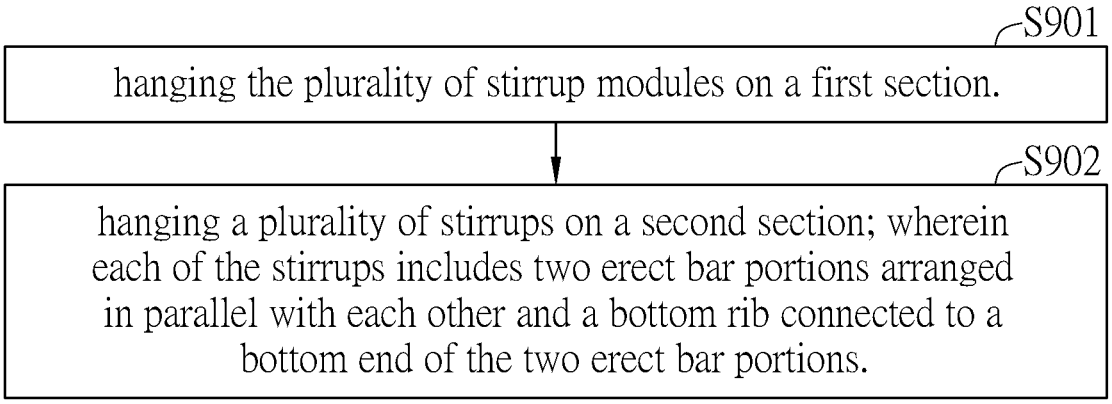
FIG. 9 is a flowchart of the detailed steps of the manufacturing method of beam reinforcement system of the present invention.
Figure 10:
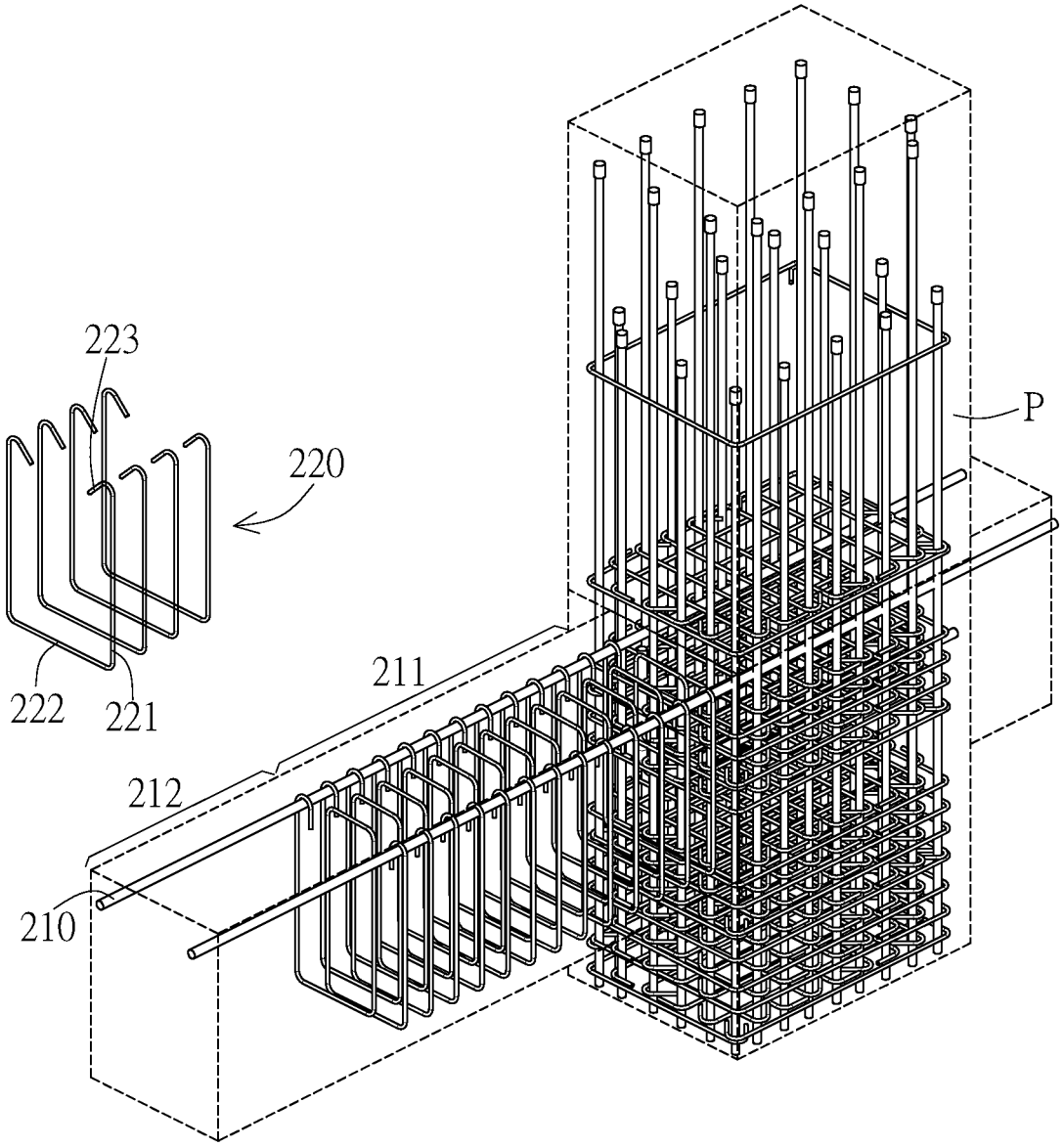
FIG. 10 shows the state of the detailed steps of the manufacturing method of the present invention.

Then, please refer to, FIG. 9 illustrates further detailed steps of the manufacturing method of beam reinforcement system of the present invention. The manufacturing method of the present invention is proceeded to a detailed step S901 of hanging the plurality of stirrup modules 100 on a first section 211. Specifically, as illustrated in FIG. 10, the stirrup modules 100 of the present invention 100 are hanged on the first section 211 of the first main bars 210 in advance.

Figure 11:
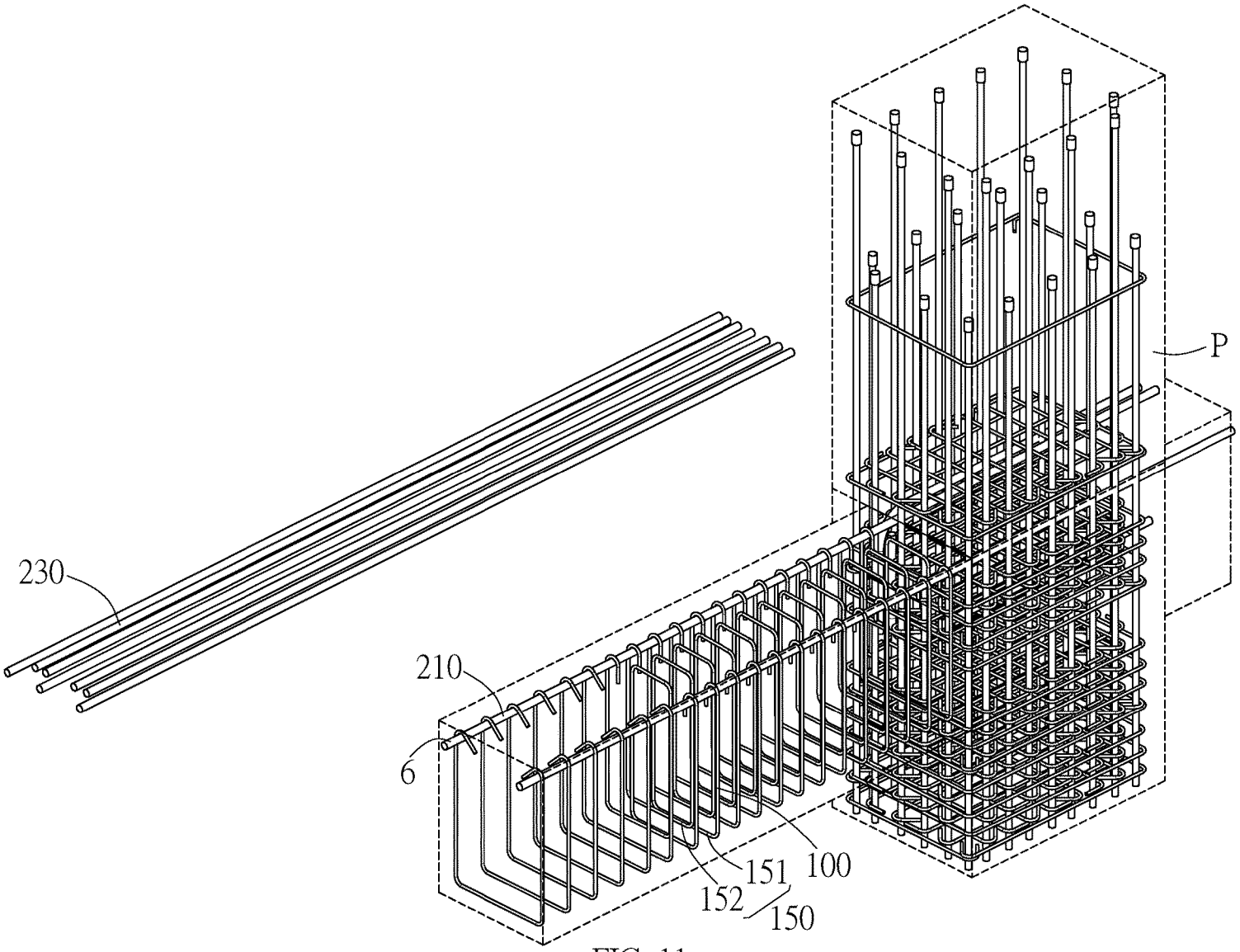
FIG. 11 shows the state of the main step 3 of the manufacturing method of the present invention.

The manufacturing method of the present invention proceeds to a detailed step S902 of hanging a plurality of stirrups 220 on a second section 212, wherein each of the stirrups 220 includes two erect bar portions 221 arranged in parallel with each other and a bottom rib 222 connected to a bottom end of the two erect bar portions 221. Specifically, as illustrated in FIG. 10, each of the stirrups 220 further includes a hook end 223. The hook end 223 extend on top ends of the two erect bar portions 221 arranged in parallel with each other. As illustrated in FIG. 11, the stirrups 220 are hanged on the second section 212 of the first ribs 210 via the hook end 223. The first section 210 and the second section 212 of the present embodiment respectively correspond to a plastic corner area and non-plastic corner area in the actual application. The first section 211 is a section closed to the vertical reinforcing steel body P, and is capable of making the hooping force of the main bars of the bean reinforcement system of the present invention along a vertical direction be distributed evenly.

Figure 12:
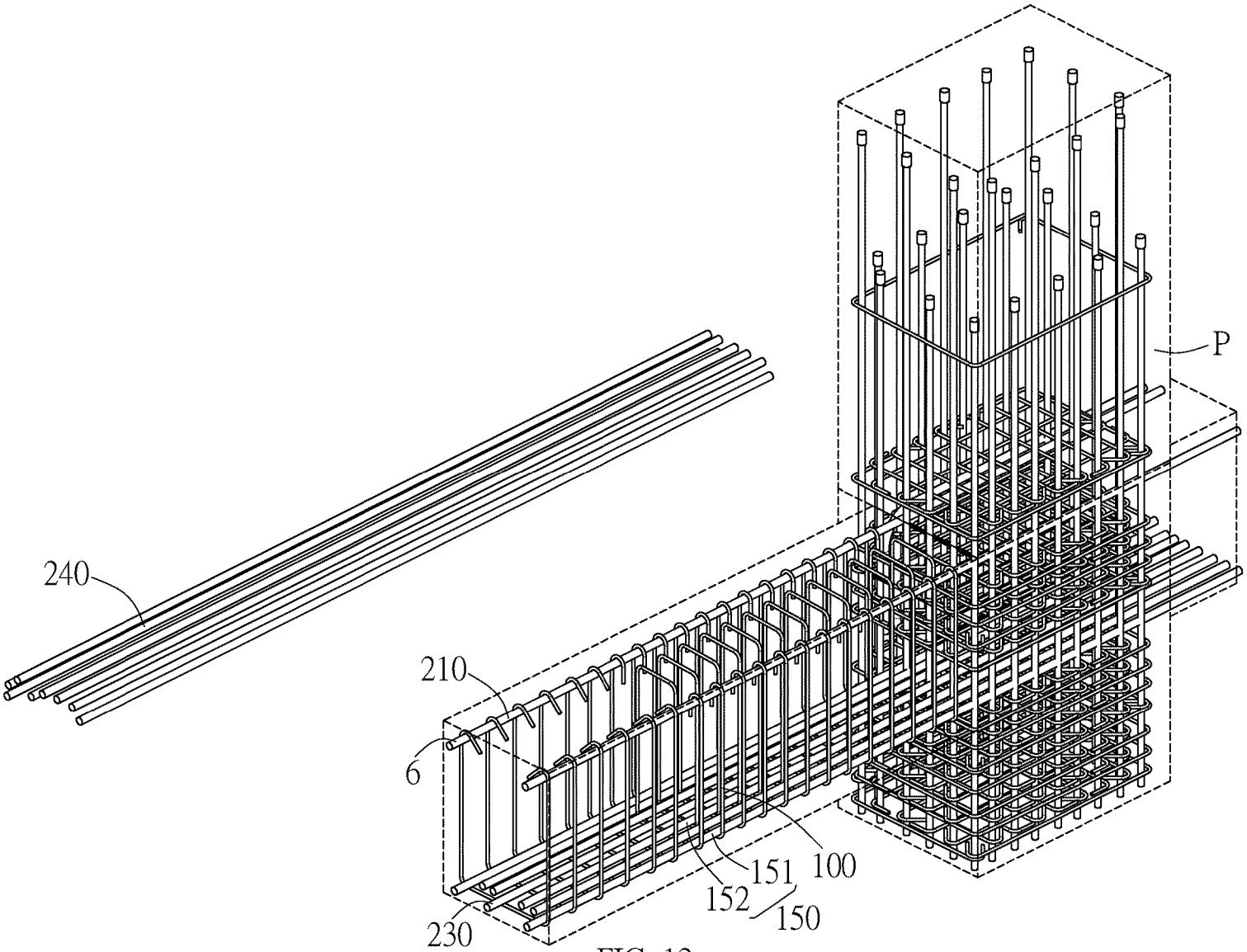
FIG. 12 shows the state of the main step 4 of the manufacturing method of the present invention.
Figure 13:
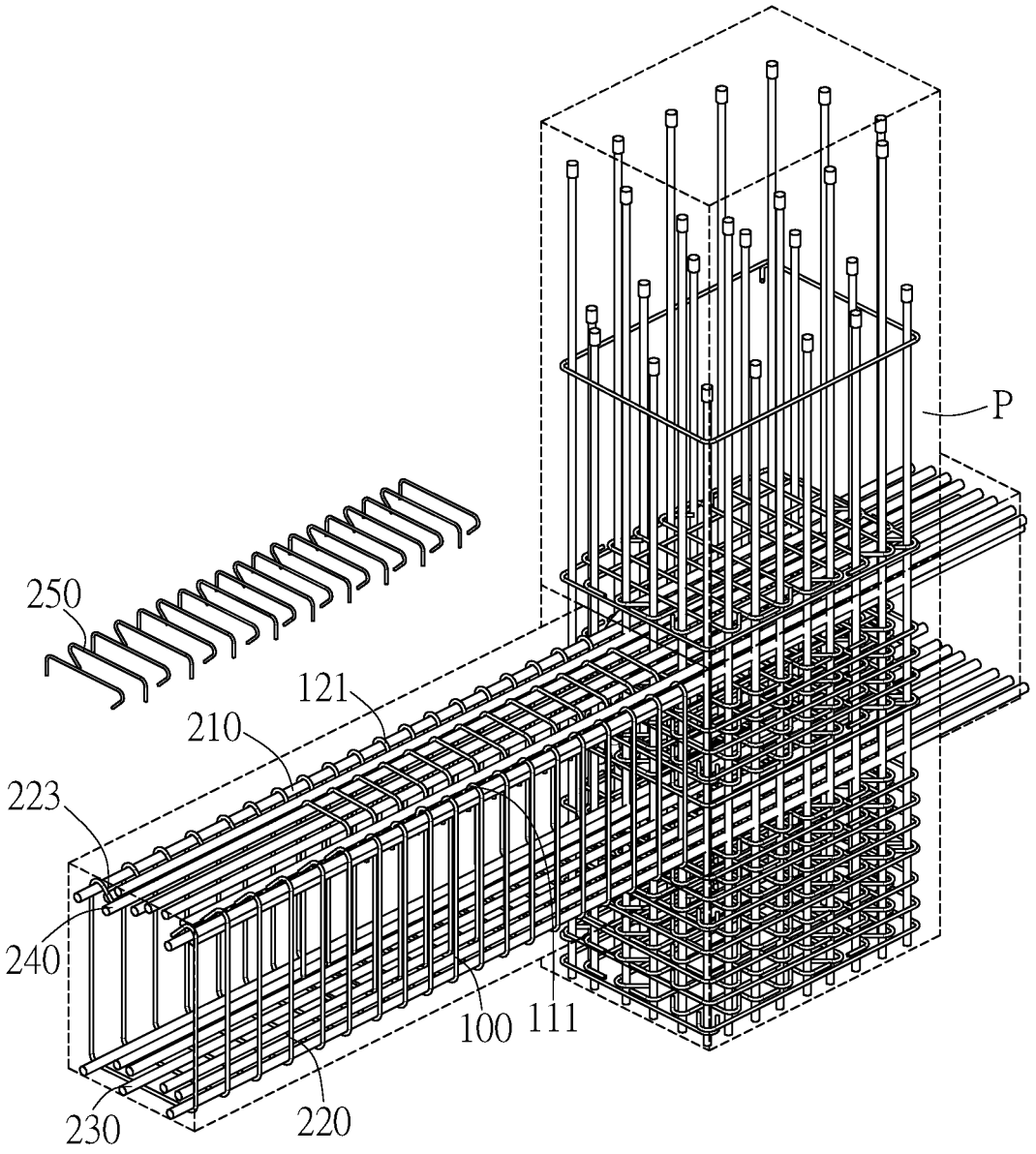
FIG. 13 shows the state of the main step 5 of the manufacturing method of the present invention.

The manufacturing method of the present invention is proceeded to a step S503 of providing a plurality of second main bars 230 on the bottom rib sections 150 of the plurality of stirrup modules 100 via the plurality of openings. Specifically, as illustrated in FIG. 11 and FIG. 12, the second main bars 230 may pass through the vertical reinforcing steel body P and be disposed on the first bottom rib 151 and the second bottom rib 152 of the bottom rib section 150 of the stirrup module 100 of the present invention The manufacturing method of the present invention is proceeded to a step S504 of providing a plurality of third main bars 240 on the plurality of stirrup modules 100. Wherein, the first ribs 210 and the third ribs 240 are arranged in parallel with each other. Specifically, as illustrated in FIG. 12 and FIG. 13, the third main bars 240 may pass through the vertical reinforcing steel body P, and some of the third main bars 240 are hooked by the stirrup module 100 of the present invention horizontally, the others of third main bars 240 are provided on openings at the end opposite to the bottom rib section 150 of the stirrup module 100 and bonded by fixed members, and are arranged in parallel with the first main bars 210 on a same horizontal surface. The fixed members in the preferred embodiment of the present invention are iron wires; however, materials and external forms of the fixed members are not limited thereto in the actual application.

Figure 14:
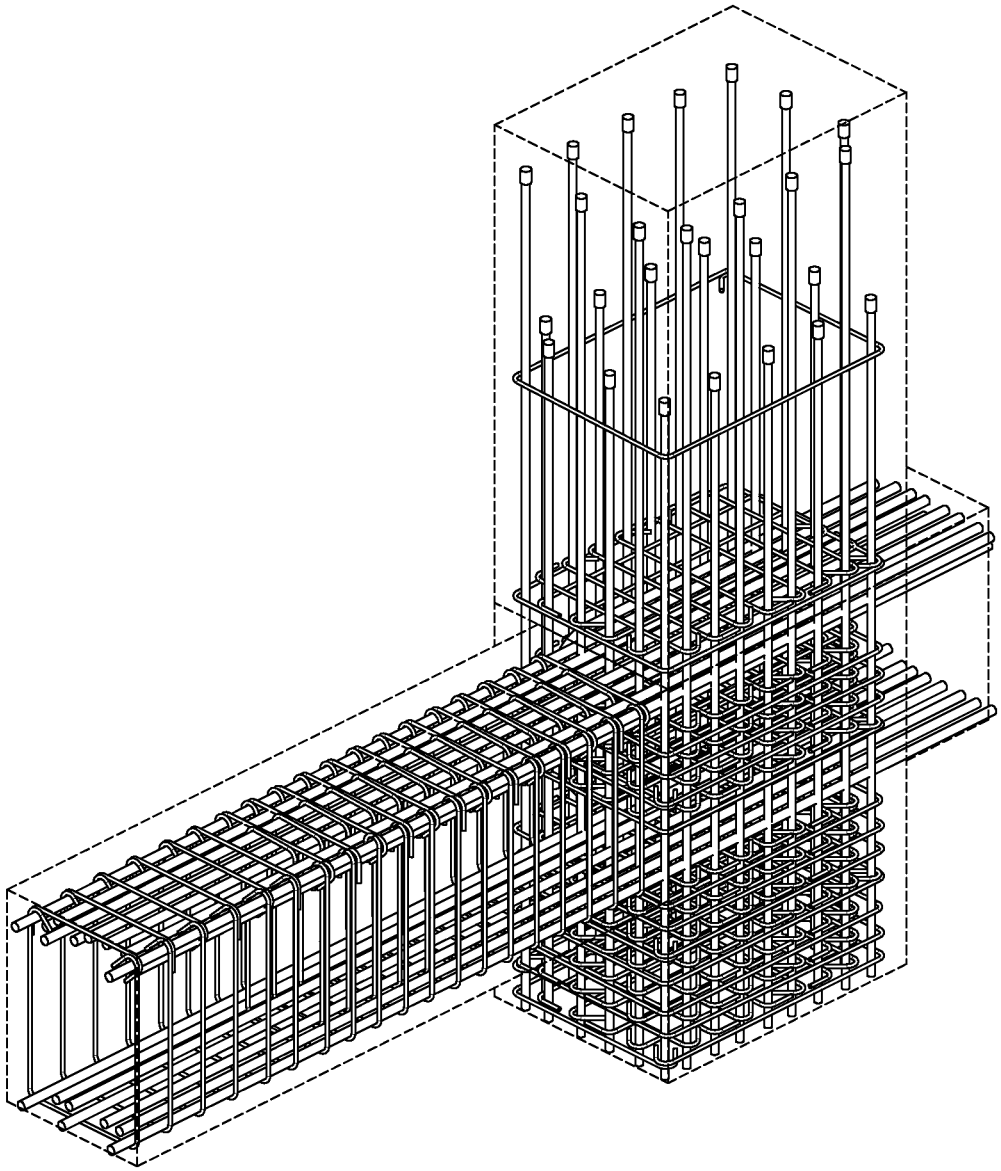
FIG. 14 shows the beam reinforcement system of the present invention.

Finally, the manufacturing method of the present invention is proceeded to a step S505 of providing a plurality of stirrup caps 250 on the plurality of stirrup modules 100. Wherein the stirrup caps 250 are provided in correspondence with these openings. Specifically, as illustrated in FIG. 13 and FIG. 14, more specifically, as illustrated in FIG. 13, the stirrup caps 250 will be provided corresponding to openings of the stirrups 220 and the stirrup modules 100. In the preferred embodiment of the present invention, each of the stirrup caps 250 is configured to be hooked on the main bars 210 beside the hook end 223 of the stirrups 220, so that each of the stirrups 220 has a stirrup cap 250 disposed on it, and the stirrup caps 250 is configured to corresponding to the opening of the stirrups 220. One of the stirrup caps 250 are disposed on the hook ends 111/121 located on two ends of each of the stirrup modules 100. Finally, please refer to FIG. 14, which illustrates a completed state diagram of the beam reinforcement system of the present invention.

Through providing the stirrup module for the reinforcement system of the present invention on the cross-section of the main bars on the same horizontal surface and simplifying the disposition of the main bars, engineering time of manufacturing the stirrup modules can be shortened.

The aforementioned embodiments of present invention can be modified by people skilled in the art, these modification does not exceed over the scope of the present disclosure disclosed in attached claims. Therefore, equivalent variations and modifications based on the contents of claims and specification of the present invention should belong to the scope of the present invention.

What is claimed is:

1. A stirrup module, comprising:

a first erect bar portion;

a second erect bar portion arranged in parallel with the first erect bar portion;

a third erect bar portion arranged in parallel with the first erect bar portion and located between the first erect bar portion and the second erect bar portion;

a fourth erect bar portion arranged in parallel with the first erect bar portion and located between the third erect bar portion and the second erect bar portion;

wherein a first gap is between the first erect bar portion and the third erect bar portion, and a second gap is between the second erect bar portion and the fourth erect bar portion; and a bottom rib section having a first portion substantially planar with and overlapping a second portion, wherein the bottom rib section is disposed to connect at least portion of the bottom ends of the first erect bar portion, the second erect bar portion, the third erect bar portion and the fourth erect bar portion, and configured to form bottom portions of the first gap and the second gap; and wherein the first gap and the second gap are each formed with an opening at the end opposite to the bottom rib section.

2. The stirrup module of claim 1, wherein the bottom rib section includes a first bottom rib and a second bottom rib; the first bottom rib is connected to the first erect bar portion; the fourth erect bar portion is connected to the first bottom rib; the first erect bar portion is connected to the fourth erect bar portion via the first bottom rib; the second bottom rib is connected to the second erect bar portion; the third erect bar portion is connected to the second bottom rib; and the second erect bar portion is connected to the third erect bar portion via the second bottom rib.

3. The stirrup module of claim 1, further comprising a first top rib, wherein the first top rib is connected to the third erect bar portion, the fourth erect bar portion is connected to the first top rib, the third erect bar portion is connected to the fourth erect bar portion via the first top rib.

4. The stirrup module of claim 3, the third erect bar portion, the first top rib, and the fourth erect bar portion are configured to form a first hang portion.

5. The stirrup module of claim 1, wherein the first erect bar portion has a hook end.

6. The stirrup module of claim 1, wherein the second erect bar portion has a hook end.

7. A stirrup module, comprising:

a first erect bar portion;

a second erect bar portion arranged in parallel with the first erect bar portion;

a first inner ring disposed between the first erect bar portion and the second erect bar portion;

wherein a first gap is between the first erect bar portion and the first inner ring, and a second gap is between the second erect bar portion and the first inner ring;

a first bottom rib disposed to connect bottom ends of at least portion of the first erect bar portion and the first inner ring, and configured to form a bottom portion of the first gap; and a second bottom rib disposed to connect bottom ends of at least portion of the second erect bar portion and the first inner ring, and configured to form a bottom portion of the second gap, wherein the first bottom rib is substantially planar with and overlaps the second bottom rib;

wherein the first gap is formed with an opening at the end opposite to the first bottom rib; the second gap is formed with an opening at the end opposite to the second bottom rib.

8. The stirrup module of claim 7, wherein the first inner ring includes a third erect bar portion, a fourth erect bar portion, a first top rib, at least portion of the first bottom rib, and at least portion of the second bottom rib, the third erect bar portion is arranged in parallel with the first erect bar portion and located between the first erect bar portion and the second erect bar portion; the fourth erect bar portion is arranged in parallel with the first erect bar portion and located between the third erect bar portion and the second erect bar portion; the third erect bar portion is connected to the fourth erect bar portion via the first top rib.

9. The stirrup module of claim 8, wherein the first bottom rib is configured to connect the fourth erect bar portion and the first erect bar portion, the second bottom rib is configured to connect the second erect bar portion and the third erect bar portion so that the first bottom rib and the second bottom rib are staggered and overlapped with each other.

10. The stirrup module of claim 8, the third erect bar portion, the first top rib, and the fourth erect bar portion of the first inner ring are configured to form a first hang portion.

11. The stirrup module of claim 7, wherein the first erect bar portion has a hook end.

12. The stirrup module of claim 7, wherein the second erect bar portion has a hook end.

13. A stirrup module, comprising:

a first erect bar portion having a first bend portion;

a first bottom rib bended relative to the first erect bar portion from a connection end of the first bend portion and extending to a second bend portion;

a fourth erect bar portion bended relative to the first bottom rib from a connection end of the second bend portion so as to be arranged in parallel with the first erect bar portion, and extending to a third bend portion;

a first top rib bended relative to the first erect bar portion from a connection end of the third bend portion so as to be arranged in parallel with the first bottom rib, and extending to a fourth bend portion;

a third erect bar portion bended relative to the first bottom rib from a connection end of the fourth bend portion so as to be arranged in parallel with the first erect bar portion and extending to a fifth bend portion;

a second bottom rib bended relative to the first erect bar portion from a connection end of the fifth bend portion and extending to a sixth bend portion, and disposed to be staggered and overlapped with the first bottom rib, and wherein the first bottom rib is substantially planar with overlaps and the second bottom rib; and a second erect bar portion bended relative to the second bottom rib from a connection portion of the sixth bend portion and arranged in parallel with the first erect bar portion;

wherein a first gap is between the first erect bar portion and the third erect bar portion, and a second gap is between the second erect bar portion and the fourth erect bar portion; and wherein the first gap and the second gap are formed with an openings at the end opposite to the first bottom rib and the second bottom rib, respectively.

14. The stirrup module of claim 13, wherein the fourth erect bar portion, the third erect bar portion, and the first top rib are configured to form a first hang portion.

15. The stirrup module of claim 13, wherein the first erect bar portion has a hook end.

16. The stirrup module of claim 13, wherein the second erect bar portion has a hook end.

* * * * *